US008360354B2

(12) United States Patent
Rossigneux

(10) Patent No.: US 8,360,354 B2
(45) Date of Patent: Jan. 29, 2013

(54) DEVICE FOR ROTATIONAL DRIVING

(75) Inventor: Bernard Rossigneux, Lezigneux (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 345 days.

(21) Appl. No.: 12/743,301

(22) PCT Filed: Nov. 15, 2007

(86) PCT No.: PCT/FR2007/001879

§ 371 (c)(1),
(2), (4) Date: Aug. 12, 2010

(87) PCT Pub. No.: WO2009/063139

PCT Pub. Date: May 22, 2009

(65) Prior Publication Data

US 2011/0265592 A1 Nov. 3, 2011

(51) Int. Cl.
*B65H 18/10* (2006.01)
*B65H 19/22* (2006.01)
*B21C 47/04* (2006.01)

(52) U.S. Cl. ..... 242/540; 424/533.6; 424/545; 424/530; 29/402.03; 29/402.04; 29/402.08; 74/665 N

(58) Field of Classification Search ..... 242/533, 242/533.2, 533.4, 533.5, 533.6, 540, 545, 242/530, 564, 474.3, 474.4, 474.5; 29/402.01, 29/402.03, 402.04, 402.08; 74/665 L, 665 N, 74/665 Q See application file for complete search history.

(56) References Cited

U.S. PATENT DOCUMENTS

| | | | |
|---|---|---|---|
| 3,243,135 | A | 3/1966 | Grünbaum |
| 4,663,986 | A | 5/1987 | Yamamoto et al. |
| 5,123,603 | A | 6/1992 | Hayez et al. |

FOREIGN PATENT DOCUMENTS

| | | | |
|---|---|---|---|
| EP | 0409311 | A1 | 1/1991 |
| JP | 59019026 | A | 1/1984 |
| JP | 62130947 | A | 6/1987 |
| JP | 2286551 | A | 11/1990 |
| RU | 2192379 | C1 | 11/2002 |
| SU | 348469 | A | 9/1972 |
| SU | 1527117 | A1 | 12/1989 |

*Primary Examiner* — William E Dondero

(74) *Attorney, Agent, or Firm* — Laurence A. Greenberg; Werner H. Stemer; Ralph E. Locher

(57) ABSTRACT

A device for rotating at least one mandrel coupled to a secondary reduction gear that can in turn be coupled to a primary reduction gear and supplies a torque to the mandrel. The primary reduction gear is driven by at least one driving motor, the primary and secondary reduction gears are mechanically similar and can be coupled via at least one torque transmission means rotated by the primary reduction gear along a rotation axis, the torque transmission means includes at least one coupling tube with two section ends. Furthermore, in the assembled configuration, the primary and secondary reduction gears define a unitary assembly integrally encapsulating the torque transmission means that can be removed from the unitary assembly in the permanent assembled configuration through an opening of the unitary assembly formed in at least one of the walls of the primary and secondary reduction gears opposite the section ends of the torque transmission means.

17 Claims, 6 Drawing Sheets

DEVICE FOR ROTATIONAL DRIVING

BACKGROUND OF THE INVENTION

Field of the Invention

The present invention concerns a device for rotational driving of at least one mandrel coupled to a secondary reduction gear which may be coupled to a primary reduction gear and supplying a torque to the mandrel.

The invention also covers the advantageous uses of the device as well as a maintenance method for the device.

In particular, within the context of the transformation processes of metal strips, such as cold or hot rolled steel strips, machines known as unwinding machines are required in order to unwind a coiled strip for example on a processing line, to subject them to the necessary transformation operations such as cold rolling, stripping, galvanizing, etc. Then after transformation of the strip, the latter is in general re-rolled in the form of a coil on a machine known as a winding machine. With regard to unwinding, each completely unwound coil is replaced by another coil to be processed and each coil rewound after processing is discharged in order to allow space for the arrival of the strip which will comprise the next coil. It follows that downtime is inevitable for loading coils to be processed and for discharging processed coils which may penalize the profitability of the installations. This is why modern processing lines are organized and designed in order to process strips in a continuous manner. To this end, a joint welder enables the tail end of an incoming strip at the end of unwinding to be joined to the head of the next strip. During the time required for the strip to stop moving in the welder, a strip accumulator returns the previously accumulated strip downstream of the line which thus allows for the continuous unwinding of a transformation process. At the output of a transformation installation, the strip is cut width-wise (perpendicular to the running direction during coiling) as soon as the coil formed on a winder equipped with a winding mandrel reaches a desired diameter. Also, the head of the strip cut during unwinding is then free and must therefore be immediately engaged on a mandrel of another winder. To this effect, two independent winders or one dual winder known as a "carousel" winder may be used as described in FIG. 1.

Figure 1:
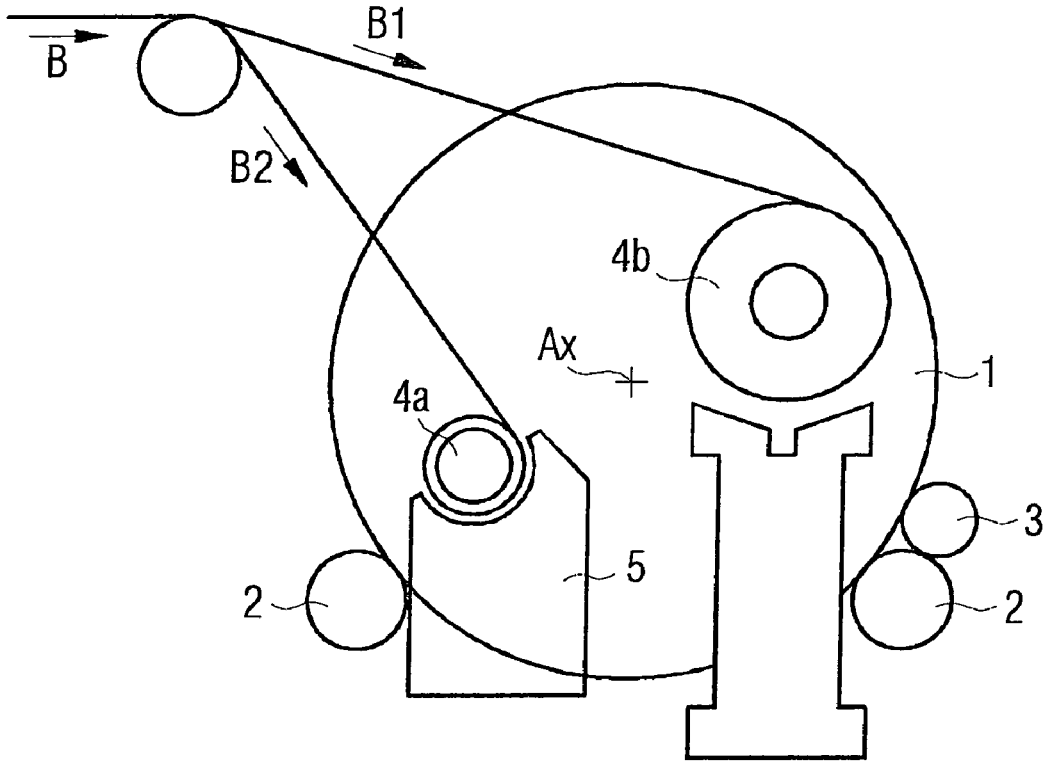
FIG. 1 PRIOR ART

FIG. 1 depicts the side view of a carousel type winder in relation to an unwinding direction of the strip (B, B1, B2). The winder is characterized by two winding mandrels (4*a*, 4*b*) positioned on one of the faces of a drum (1). The two mandrels are coupled when driving independently of the drum (1) itself rotating around a rotation axis (Ax). The mandrels also rotate around parallel rotation axes positioned eccentrically on a diameter of the drum (1) and parallel to the rotation axis (Ax). The drum (1) pivots on rollers (2) around the rotation axis (Ax) using a driving system (3) which enables each of the mandrels to be placed alternately in a first start of winding position opposite a device (5) intended to ensure the winding of the first turns on the mandrel in the first position, or in a second coil winding and discharge position above a discharge carriage (6) which is diametrically opposite on the drum in the first position. The mandrels are more commonly driven by one or more electric driving motors through gear devices as described kinematically in FIG. 2.

Figure 2:
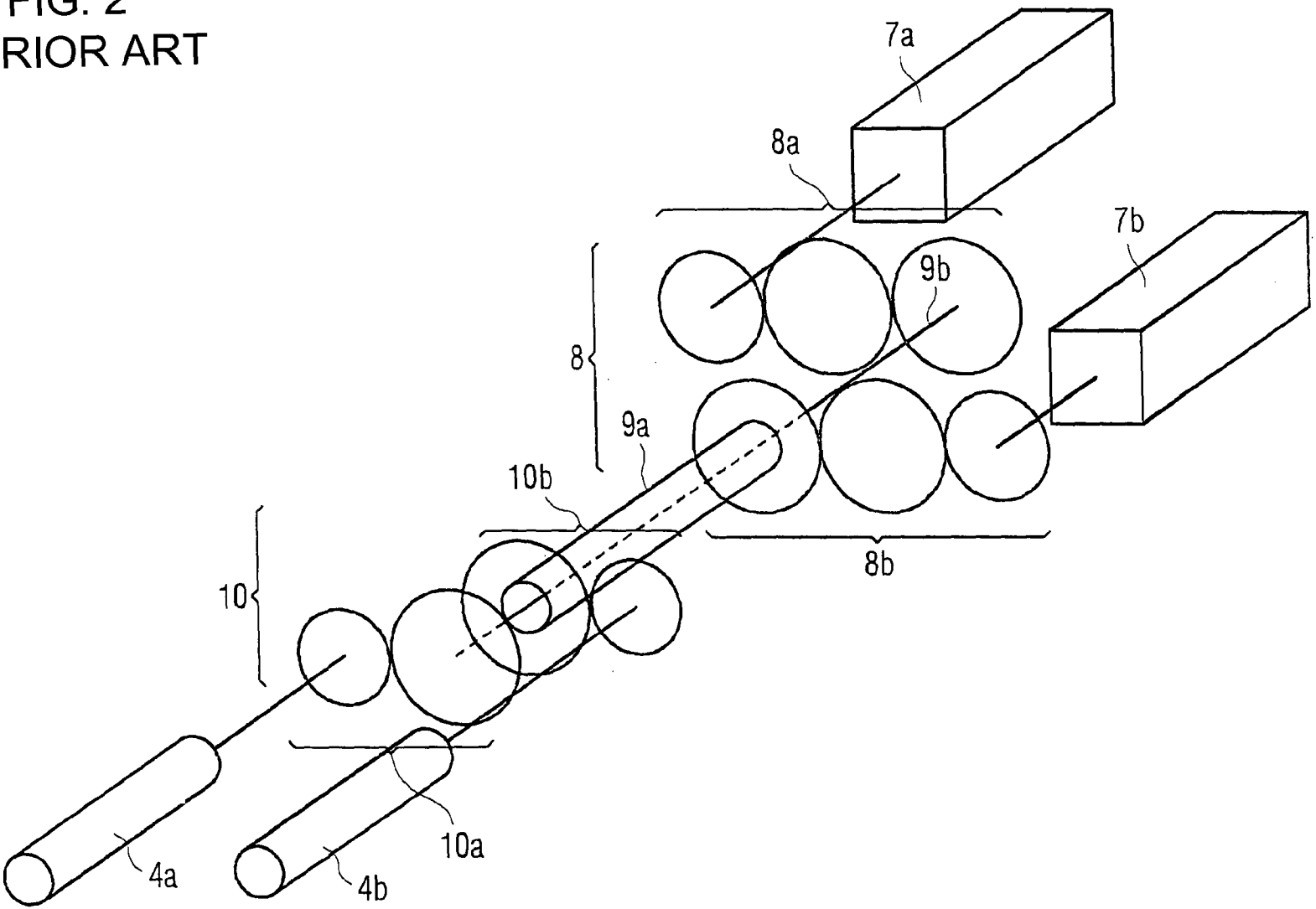
FIG. 2 PRIOR ART

FIG. 2 thus schematizes known kinematics of driving a carousel type winder according to FIG. 1. In the present case, two driving motors (7*a*, 7*b*) activate two inputs of a primary reduction gear (8). The first gears (8*a*) at the output of the primary reduction gear (8) transmit a torque from a first motor (7*a*) to a first transmission shaft (9*a*) and the second gears (8*b*) transmit a torque from the second motor (7*b*) to a second transmission shaft (9*b*). The two transmission shafts (9*a*, 9*b*) then comprise a torque transmission means (9) the output of which activates two inputs of a secondary reduction gear (10) which, as a general rule, is located inside the pivot drum as in FIG. 1 (not represented here). The first transmission shaft (9*a*) transmits an output torque to the gears (10*a*) which activate the first mandrel (4*a*) and the second transmission shaft (9*b*) transmits the torque to the gears (10*b*) which activate the second mandrel (4*b*).

Figure 3:
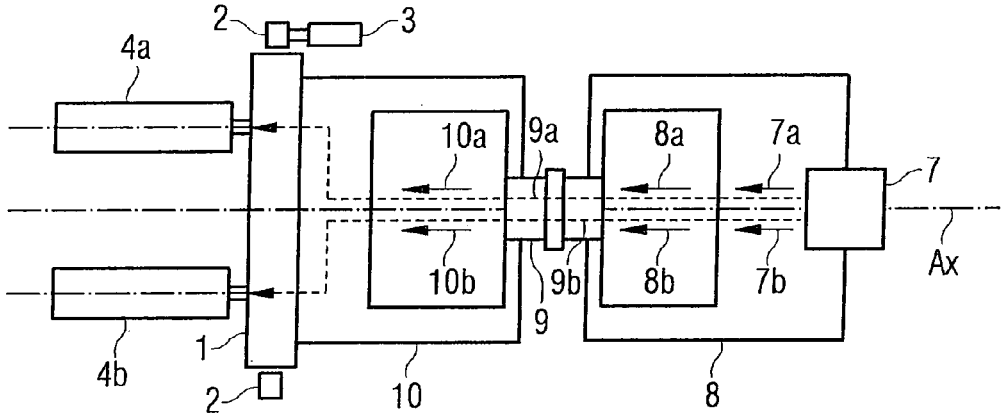
FIG. 3 PRIOR ART

FIG. 3 also presents the side view of an example of a schematized carousel type device in relation to an unwinding direction of the strip according to FIGS. 1 and 2. In particular, it should be noted that the primary and secondary reduction gears (8, 10) form two units which can be mechanically assembled or separated from an input of one and an output of the other which generally surrounds the torque transmission means (9, 9*a*, 9*b*). Such an assembly and disassembly enables the transmission shafts (9, 9*a*, 9*b*) to be removed for maintenance purposes. This is more generally useful in the maintenance of successive torque transmission means (7*a*, 7*b*; 8*a*, 8*b*; 9*a*, 9*b*; 10*a*, 10*b*) from the output of the motor (7) to the output of the secondary reduction gear (10). If necessary, it is possible to provide other sub-structures in assembly and disassembly units in order to separate each of the components surrounding the torque transmission means (9, 9*a*, 9*b*). Consequently, maintenance in terms of the transmission is an operation which requires complex operations along successive transmission components.

This is a standard arrangement and is described in several documents such as JP 62-130947, JP 59-19026 and U.S. Pat. No. 4,663,986.

The first two documents JP 62-130947, JP 59-19026 describe carousel type devices of which the torque transmission shafts between the primary and secondary reductions gears are positioned in a coaxial or concentric manner with one inside the other.

Document U.S. Pat. No. 4,663,986 comprises an almost identical carousel type device to FIGS. 1 and 2 of document JP 59-19026, but justly accepts that this coaxial arrangement renders the assembly, disassembly, monitoring and maintenance of the transmission shafts difficult. A different design is therefore proposed, based on the use of two torque transmission shafts which are juxtaposed in parallel, supported by several bearings equipped with several couplings and entering the secondary reduction gear through a cylindrical part which is integrated into the drum carrying mandrels which ensures they are guided in rotation into one of the two drum positions. Although this solution effectively resolves certain problems posed by the coaxial transmission shafts like the relative difficulty in machining said shafts, it does not, however, decisively facilitate the assembly, disassembly or maintenance operations of the carousel type device due to the significant number of coupling parts, shaft support bearings etc., which is therefore necessary for assembly and disassembly. Moreover, due to the coaxial design, the need to leave a certain distance between the torque transmission shafts results in an increase in the centre-to-centre distance between the motors and between the mandrels, which contributes towards an increase in the weight and cost of the equipment as well as the site coverage.

BRIEF SUMMARY OF THE INVENTION

One aim of the present invention is to propose a device for rotational driving suited to a carousel type device and the maintenance of which is simplified.

To this end, a device for rotational driving is proposed, comprising at least one mandrel coupled to a secondary reduction gear, that can in turn be coupled to a primary reduction gear and supplies a torque to the mandrel wherein:

the primary reduction gear is driven by at least one driving motor, the primary and secondary reduction gears are mechanically similar and can be coupled by at least one torque transmission means rotated by the primary reduction gear along a rotation axis, the torque transmission means includes at least one coupling tube with two section ends.

It is also designed such that in a (mechanically) assembled configuration, the primary and secondary reduction gears form a unitary assembly integrally encapsulating the torque transmission means that can be removed from the unitary assembly in the permanent assembled configuration through an opening in the unitary assembly located in at least one of the walls of one of the primary and secondary reduction gears opposite one of the section ends of the torque transmission means.

This aspect gives a considerable technical advantage in the sense that during maintenance of the driving device, it is no longer necessary to separate the primary reduction gear from the secondary reduction gear in order to uncouple the two units and to control or even change the torque transmission means subject to wear or at least to adequate lubrication. Consequently, contrary to the state-of-the-art, complex disassembly and re-assembly phases related to the primary and secondary reduction gears as well as their gear components are noticeably avoided. This is particularly significant for a carousel type device for a processing line of a moving metal strip, wherein the primary and secondary reduction gears form units which are considerable in size (several meters in diameter) and weight (several tons), which renders mechanical disassembly very complex, in order to be able to uncouple them during torque transmission. Thanks to the previous device for rotational driving, the mechanical disassembly stage is avoided, in other words, the primary and secondary reduction gears remain, for example, fixed on their foundations just as their first installation in the assembled configuration (unitary assembly) on their place of operation.

It should be noted that said driving device is suited to driving a single mandrel connected by coupling to a driving motor through a torque transmission shaft that can be inserted through two primary and secondary reduction gears. In this way, the invention, even though principally described on the basis of a carousel type device, is favorably suited to a single driving device of a mandrel. Multiple fields of application of the invention are therefore possible rendering their maintenance considerably simplified. Amongst them, said device may be used to drive a simple coil on a processing line for a moving strip (metallurgic, paper, plastic, etc.) but also for tools such as a drilling machine, a lathe, etc.

In the subsequent description, example embodiments of the device according to the invention will be described in order to show that the present invention can also be adapted to several categories of carousel devices such as those equipped with a concentric or juxtaposed torque transmission shaft.

Example embodiments provide an understanding that the invention is noticeably suited to all types of very common single and bi-mandrel configurations as well as to configurations of more than two mandrels.

Finally, a very simplified maintenance process for the device is therefore advantageously possible comprising the following points:

at least one coupling tube is released and extracted from the unitary assembly through the opening, the coupling tube undergoes a maintenance stage, the coupling tube is re-inserted through the opening and locked in the unitary assembly again.

Thus, the coupling tube can be easily released and extracted from the unitary assembly after a permanent installation of the primary and secondary reduction gears according to the assembled configuration thus performed a single time.

For a processing line of the steel strip, the units of primary and secondary reduction gears may reach several dozen tons each, and their mechanical separation (as well as during driving) and their reassembly require the use of bridge cranes as well as multiple loosening and tightening of common connections. In other words, by means of a driving device according to the invention, a maintenance phase is completely free of highly complex and heavy disassembly and assembly operations of the primary and secondary reduction gears as only the torque transmission means (one or several coupling tubes which are less heavy and easy to move) is dismantled and reassembled in relation to the unitary assembly. Maintenance is thus considerably simplified and accelerated.

A set of sub-claims also presents the advantages of the invention.

Figure 4:
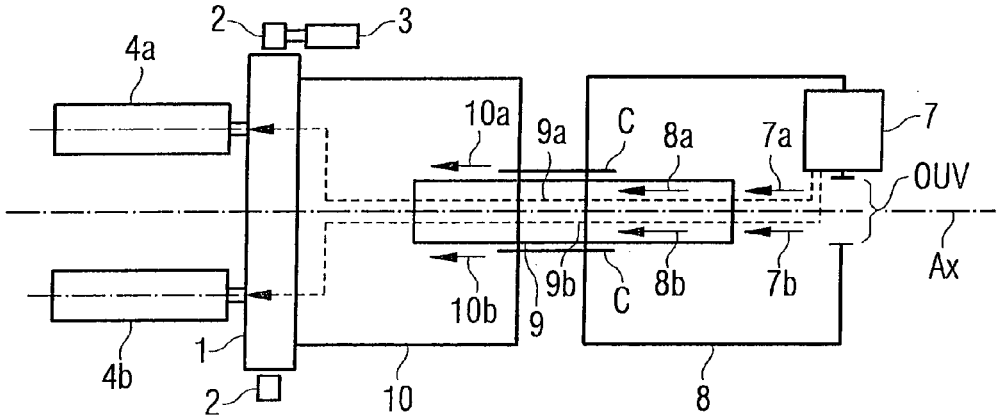
Figure 5:
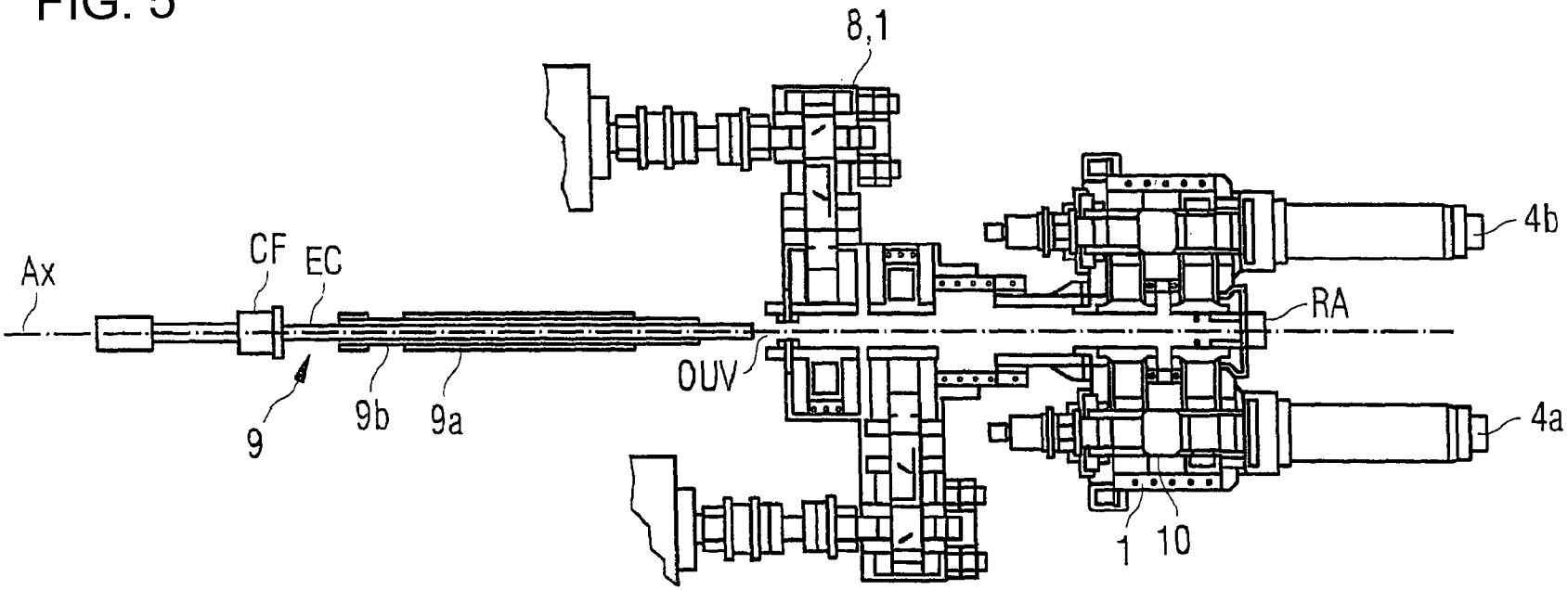
Figure 6:
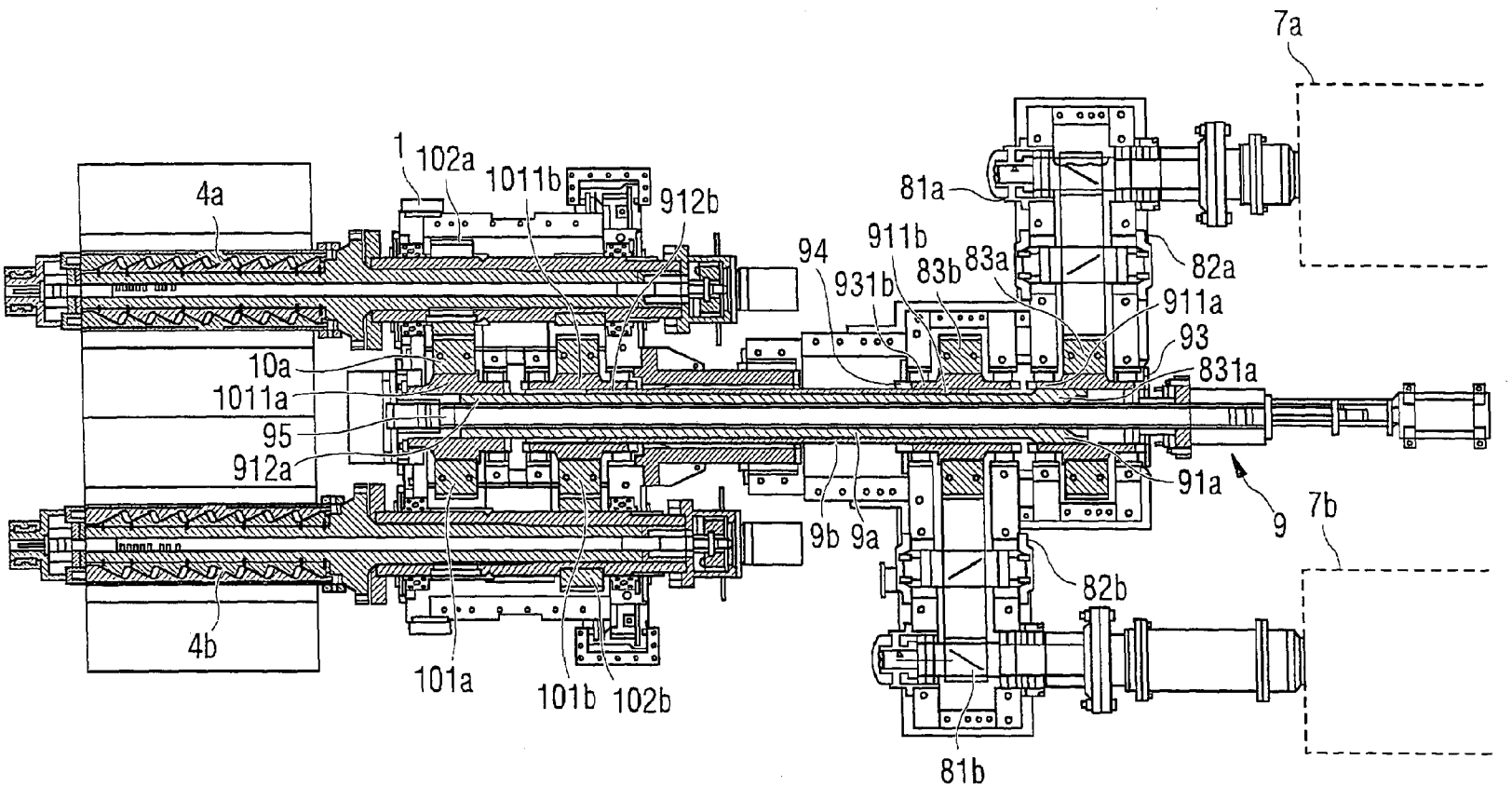
Figure 7:
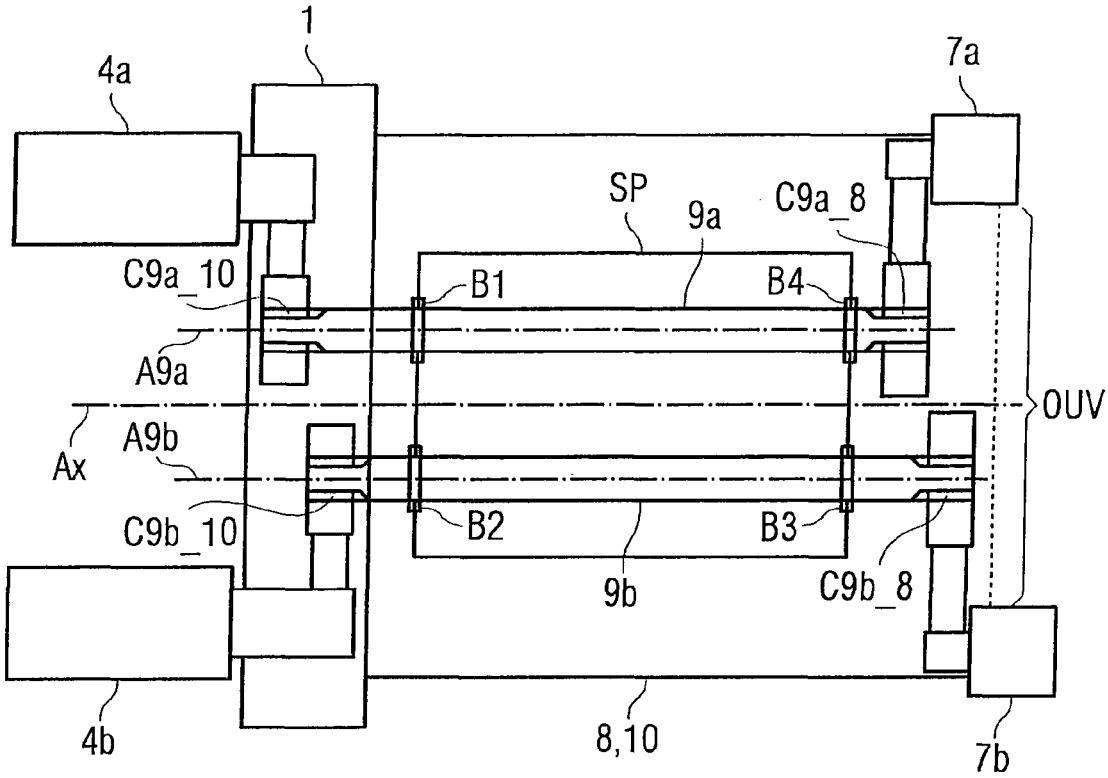

Examples of embodiments and application are provided using the figures described:

FIG. 4 a schematized device for the rotational driving of two mandrels according to the invention, FIG. 5 a carousel type assembly according to the invention equipped with concentric transmission shafts in a maintenance phase, FIG. 6 a detailed view of the carousel type assembly according to FIG. 5 in an operating phase, FIG. 7 a carousel type assembly according to the invention equipped with juxtaposed transmission shafts.

FIG. 4 represents a carousel type assembly according to the invention comprising a device for the rotational driving of two mandrels (4*a*, 4*b*) coupled to a secondary reduction gear (10), the input of which can be coupled (in terms of coupling by rotational driving) to a primary reduction gear (8) and the output of which supplies a torque to each of the mandrels. Principally, the driving device has the following characteristics:

the primary reduction gear is driven by at least one driving motor (7*a*, 7*b*), the primary and secondary reduction gears can be coupled by at least one torque transmission means (9, 9*a*, 9*b*) which is driven in rotation by the primary reduction gear according to a rotation axis (Ax), the torque transmission means comprises at least one coupling tube (here two tubes 9*a*, 9*b*) with two section ends (each ending up in one or the other unit formed respectively by the primary and secondary reduction gears).

In comparison to FIG. 3, the primary and secondary reduction gears, however, form a unitary assembly integrally encapsulating the torque transmission means (9, 9*a*, 9*b*) that can be removed from the unitary assembly through an opening (OUV) in the unitary assembly located on at least one of the walls of one of the primary and secondary reduction gears, preferably opposite one of the section ends of the torque transmission means. The opening (OUV) is therefore located here centered on the rotation axis (Ax) downstream of the primary reduction gear (8). To this end, any motor unit (7) supplying one or two torques (7*a*, 7*b*) at its output is positioned on the opening side in order that the torque transmission means may be inserted or removed when moving according to its rotation axis (Ax) into or out of the unitary assembly, without the unitary assembly being separated at any point. The unitary assembly, in other words the enveloping means of the two reduction gears (8, 10) may also include a guide channel (C) in which the coupling tubes (9*a*, 9*b*) are inserted and maintained if necessary. As a general rule, the secondary reduction gear (10) is interdependent or even integrated in the drum (1) which pivots on the rollers (2) driven in rotation by a motor (3). The secondary reduction gear may however also remain immobilized and fixed in relation to the primary reduction gear unit, in which case, the drum rotates in relation to the secondary reduction gear.

More generally this device, and in particular the drum/secondary reduction gear, comprises one or more mandrels being one or more components which may be separated during driving and mechanically from the secondary reduction gear. Such a mandrel may thus be the support of an interchangeable coil in a continuous winding and unwinding process of a strip.

However, the use of the driving device is of particular value in a processing line of a moving steel strip and may comprise the following aspects:

- at least two mandrels are positioned on the rotating drum on one of its diameters and equidistant from its rotation axis. The mandrels are thus the "carriers" of interchangeable coils;
- by rotating the drum, a driving mode of one of the mandrels (4*b*) is simply disconnected to interchange this mandrel with another mandrel (4*a*) the driving mode of which is continually ensured;
- one of the mandrels in disconnected driving mode can therefore be mechanically released from the drum;
- the mandrels and the drum are put into movement in order to perform continuous winding on the mandrels of a permanently moving flexible strip, in particular the strip being composed of a metal structure.

The driving device is suited to the rotation of the mandrels according to one single direction of rotation for a single winding of a moving strip on each of the mandrels for example, or conversely for a single unwinding. However, the invention may also make provisions such that at least one of the mandrels possesses at least one of two driving modes when coiling and uncoiling a strip according to a torque direction transmitted to the mandrel. This enables the additional operations to be performed between which, for example, it is possible to process the strip.

As shown in FIG. 5, the configuration according to FIG. 4 may be realized by means of a carousel type assembly according to the invention equipped with concentric transmission shafts in the maintenance phase. The transmission shafts are, for example, coupling tubes (9) of various diameters rotating concentrically around the rotation axis (Ax) with angular velocities imposed by the primary reduction gear (8). FIG. 5 represents in particular the case where the transmission means (9) is withdrawn from the "primary and secondary reduction gears (8, 10)" unitary assembly within the context of a maintenance procedure for the carousel type device. This maintenance process thus consists in, for example, ensuring the quick and simple coupling and uncoupling between the primary reduction gear (8) and the secondary reduction gear (10) of a carousel type winder for laminated steel strips by a coupling device (9) which may be installed and removed by the simple insertion of two concentric transmission shafts (9) through the two reduction gears remaining entirely assembled and according to the rotation axis (Ax) of the drum (1) here comprising the secondary reduction gear (10) and supporting the two mandrels (4*a*, 4*b*) on which a continuous flow of steel strip is wound alternately on one of the mandrels.

The insertion (and withdrawal) of the torque transmission means (9) is in particular performed by means of "female" bore splines of two output gears of the primary reduction gear (8) combined with "male" splines of the exterior diameters of the two coaxial coupling tubes (9*a*, 9*b*) which rotate freely on the transmission shaft (Ax) on the one hand, as well as "female" bore splines of two input gears of the secondary reduction gear (10) combined with the "male" splines of the exterior diameters of the other end of the two coaxial coupling tubes (9*a*, 9*b*) on the other hand. Said splines thus ensure the transfer of driving torques of expandable mandrels between the primary reduction gear and the secondary reduction gear. According to the fitting direction selected for the insertion and withdrawal of the torque transmission means (9), in other words, the opening (OUV) either on the side of the driving motors or on the side of the mandrels, the exterior splined diameter of the end of the interior coaxial coupling tube (9*b*) located on the assembly side (opening) is slightly greater than the exterior splined diameter of the exterior coaxial coupling tube (9*a*) in order that the latter may pass through the splined bore of the corresponding gear.

Alternative coaxial embodiments of the coupling tubes may also be envisaged, in particular, if an existing carousel type device installed in a processing line for a strip must be readapted to receive the insertion and withdrawal device of the torque transmission means (9).

Among these alternatives, the driving device according to the invention may thus comprise the following advantageous characteristics:

- Principally, two annular surfaces external to the coupling tube (9*a*) comprise external splines which can be engaged by the insertion of the torque transmission means (9) through the primary and secondary reduction gears (8, 10),
- each of the external spline rings can thus be engaged through insertion/slippage into a bore ring with internal splines of each of the primary and secondary reduction gears,
- As described above, the external splines of two external surface rings of the coupling tube have different diameters according to the first insertion side of the torque transmission means (9),
- The external splines of at least one of the two external surface rings of the coupling tube may also form a conical revolution gear ring, for example, at the level of the secondary reduction gear (10) in order to allow, after the insertion of the torque transmission means (9), a final stop or at least a simplified positioning stop (blind) on a secondary reduction gear pair (10) in the unitary assembly (8, 10),
- The previous option comprising one or more conical revolution gear rings may also be improved or indeed avoided by placing the coupling tubes (9*a*, 9*b*) on a central element (EC) which is longer than the two coupling tubes (9*a*, 9*b*) and one end of which comes to stop against a side or a stop bearing (RA) placed on the rotation axis (Ax) opposite the opening (OUV) in the bottom of the unitary assembly (8, 10), in this case, a side wall of the secondary reduction gear (10). Another end of the central element (EC) opposite the stop bearing (RA), in other words, positioned in the vicinity of the opening (OUV) can also be "stopped" by means of a closing cover type element (CF). In this way, the two ends of the central element (EC) can be easily fixed to the unitary assembly and the design as well as the positioning of the coupling tube splines (9*a*, 9*b*) along the central element (EC) can be achieved blindly in the unitary assembly without having to separate it.

It is also possible to create coupling tubes (9*a*, 9*b*) with at least one of their sections with a conical revolution surface. This possible variant principally offers the same advantages as previously cited for the conical revolution splines.

For all these alternatives, a stop and locking mechanism of the torque transmission means (9) is thus positioned in the vicinity of the opening (OUV) by means of, for example, a screwed cover and a two-part ring located in the closing cover (CF) of the opening (OUV).

Such embodiments of the device according to the invention, being easily removable and accessible from the exterior of the primary reduction gear (8), ensure on the other hand, that the two splined coupling tubes stop moving. Thus, the primary and secondary reduction gears (8, 10) may be fitted, adjusted and tested in the workshop without requiring partial removal on an installation/production site in order to ensure their connection with their appropriate coupling components, which ensures that the performance quality of a machine equipped with this device is constantly controlled.

A tube (here, for example, the central element EC) which is concentric to the two coupling tubes (9*a*, 9*b*) and located inside the interior of the coupling tube (9*b*) may serve as a tubular guide/support to the pipes transporting through the torque transmission means hydraulic expansion fluid for the mandrels (4*a*, 4*b*), one or more lubrication means necessary for any mechanical component such as grease and oil as well as electrical conductors such as various electrical cables carrying instrument control currents present in the drum (1).

It should be noted that even though the examples presented for the embodiment of the driving device comprise two mandrels for a carousel type application, the invention is also suitably adapted to a single mandrel configuration, as would be the case for a lathe, drilling machine, drill, etc. In this case, the torque transmission means (9) only comprises a single coupling tube (9*a*) driven in rotation on the central element EC.

In the same way, the invention is entirely suited to a more complex secondary reduction gear (or drum), in other words, coupled to more than two mandrels. This is significant in order to be able to manage more continuous coiling or uncoiling for one or more moving strips.

In short, according to FIG. 5 and taking the example of several mandrels:

several mandrels, (4*a*, 4*b*) are coupled when driving to a secondary reduction gear (10) through a drum (1) rotating around the rotation axis (Ax), the mandrels rotate around parallel rotation axes arranged eccentrically on a drum diameter (1) and parallel to the rotation axis (Ax).

the torque transmission means (9) comprise several coupling tubes (9*a*, 9*b*) respectively comprising a common axis of revolution (the term "axis of revolution" signifies the axis of symmetry of a tube perpendicular to its cross-section), the coupling tubes rotate concentrically around the common axis of revolution, each of the coupling tubes transmitting a torque to one of the mandrels via the secondary reduction gear (10), two section ends of one (9*a*) of the coupling tubes (9*a*, 9*b*) is less spaced out than the spacing of the two section ends of one other (9*b*) of the coupling tubes (9*a*, 9*b*). This enables the external splines of the coupling tubes to be engaged with the gears for each torque transmitted to the primary and secondary reduction gears, when said gears are positioned laterally along the rotation axis (Ax).

FIG. 6 illustrates the device according to the invention for removal of the coupling tubes by extraction from the motor side, by presenting a detailed view of the carousel type assembly according to FIG. 5 in an operating phase, in other words when the torque transmission means (9) is completely inserted in the unitary assembly (8, 10). A mechanical torque supplied by the driving motor (7*a*) is transmitted to an input pinion (81*a*) of the primary reduction gear (8) which transmits it via a pulley (82*a*) to a sprocket wheel (83*a*). One hub of this sprocket wheel is equipped with splines (831*a*) which combine with the splines (911*a*) of the head (91*a*) of the coupling tube (9*a*). Said coupling tube (9*a*) is equipped, at the opposite end (91*a*) with splines (912*a*) which combine with the splines (1011*a*) of a hub of another sprocket wheel (101*a*) which transmit via a pinion (102*a*) to the mandrel (4*a*), the torque coming from the coupling tube (9*a*). In a similar manner, a mechanical torque supplied by a driving motor (7*b*) is transmitted to an input pinion (81*b*) of the primary reduction gear (8) which transmits it via a pulley (82*b*) to a sprocket wheel (83*b*). One hub of this sprocket wheel is equipped with splines (831*b*) which combine with the splines (911*b*) of the coupling tube (9*b*). Said coupling tube (9*b*) is equipped, at the opposite end, with splines (912*b*) which combine with the splines (1011*b*) of a hub of another sprocket wheel (101*b*) which transmits via a pinion (102*b*) to the mandrel (4*b*) the torque coming from the coupling tube (9*b*). When the unitary assembly is opened (93), which is equivalent to the opening (OUV) according to FIG. 5, a system of screwed covers (831*a*) ensures that the coupling tube (9*a*) stops moving and a two-part ring (831*b*) ensures that the coupling tube (9*b*) stops moving. A tube (95), equivalent to the central element (EC) according to FIG. 5, is mounted inside the coupling tube (9*a*) and ensures the support of the hydraulic fluid and lubricant supply tubular guide and the electrical cables to the drum (1).

FIG. 7, the last example embodiment of the driving device according to the invention, concerns a carousel type assembly equipped with juxtaposed transmission shafts (coupling tubes 9*a*, 9*b*) like torque transmission means, in other words, the rotation axis (A9*a*, A9*b*) (identical to their axis of revolution) of which are in juxtaposed parallel. In other words and conversely to the previous examples, the tubes are no longer coaxial, but positioned side by side as in the state-of-the-art mentioned in U.S. Pat. No. 4,663,986.

In short, FIG. 7 more generally presents an alternative embodiment of the driving device, in that the torque transmission means comprises several coupling tubes respectively comprising an axis of revolution, the coupling tubes rotate around axis of revolution in juxtaposed parallel.

According to this example, it may be provided for that:

the coupling tubes (9*a*, 9*b*) are freely fixed in a retaining support (SP) equipped with rotating nozzles (B1, B2, B3, B4) like free bearings in order to enable each tube to rotate freely around its rotation axis (A9*a*, A9*b*), the coupling tubes (9*a*, 9*b*) comprise external splines (C9*a*_8, C9*a*_10; C9*b*_8, C9*b*_10) which fit the output gears of the primary reduction gear 8 (motors 7*a*, 7*b*) and the input gears of the secondary reduction gear 10 (mandrels 4*a*, 4*b*), the size of the external splines (C9*a*_8, C9*a*_10; C9*b*_8, C9*b*_10) is adapted to be able to pass through the opening (OUV) smoothly, as in the previous examples of the invention (concentric coupling tubes), the splines may have different diameters and/or cylindrical or conical revolution profiles, etc.

the retaining support (SP) can be removed through the opening (OUV). This thus enables all of the coupling tubes (9*a*, 9*b*, etc.) to be inserted or withdrawn from their support such as a plate which may then be easily moved out of the unitary assembly by means of a carriage or a bridge crane. The retaining support can therefore act as the central element (EC) according to FIG. 5 for stopping and locking the coupling tubes in the single unit (8, 10). The configuration of the retaining support may differ (even though not represented), for example by placing the juxtaposed tubular central elements such that they lock themselves in the stop elements located on a "false" frame the width of which is less than the opening (OUV).

In a similar manner to the case where the torque transmission means only comprised a single coupling tube, each coupling tube may also be independently removed from the unitary assembly through at least one opening (OUV) provided in one face of the unitary assembly formed by the primary and secondary reduction gears (8, 10). This thus facilitates emergency maintenance of a tube whilst the second tube still allows satisfactory operational driving, which thus considerably limits the interruption duration of a continuous processing line for a strip.

The number 1, 2, 3, 4, etc., of coupling tubes required is, however, a dominating factor for the maintenance of the driving device, as the higher the number, the more the insertion and withdrawal operations become complex and slow.

According to all of the possible example embodiments, the invention is also designed such that the driving device is adapted wherein:

the mandrels have angular velocities with independently adjustable torques and direction by means of uncoupling on distinct coupling tubes, at least one of the mandrels possesses at least one of two driving modes when coiling or uncoiling a strip according to a direction of torque transmitted to the mandrel, in other words the tubes may be rotated in optionally different directions.

Unrepresented in all figures but very favorable for the insertion and withdrawal of the coupling tube, the wall of the unitary assembly comprising the opening may be provided with guide supports (such as rails). These guide supports (such as rails) are positioned in the vicinity of the opening (OUV) enabling each coupling tube to be positioned opposite a channel (C) for insertion or withdrawal into/out of the unitary assembly. This prevents the splines or other elements projecting into the tube insertion channel from being damaged. The rails external to the unitary assembly may also be inserted into the latter simultaneously to the tubes. They may also be removed from the unitary assembly in order to be secured to a means of transport outside the unitary assembly.

The invention claimed is:

1. A device for rotationally driving at least one mandrel, comprising:

a secondary reduction gear and a primary reduction gear for supplying a torque to the mandrel;

at least one driving motor for driving said primary reduction gear;

at least one torque transmission mechanically coupling said primary and secondary reduction gears and driven in rotation by said primary reduction gear according to a rotation axis;

said torque transmission including at least one coupling tube with two section ends;

said primary and secondary reduction gears, in an assembled configuration, forming a unitary assembly integrally encapsulating said torque transmission, and wherein said unitary assembly is configured for removal through an opening formed in at least one wall of one of said primary and secondary reduction gears opposite one of said section ends of said torque transmission.

2. The device according to claim 1, wherein:

two ring surfaces on an exterior of said coupling tube comprise external splines to be engaged by inserting said torque transmission through said primary and secondary reduction gears; and each of said external spline rings may be engaged by insertion into a bore ring with internal splines of each of said primary and secondary reduction gears.

3. The device according to claim 2, wherein said external splines of said two exterior ring surfaces of said coupling tube have mutually different diameters.

4. The device according to claim 2, wherein said external splines of at least one of said two exterior surface rings of said coupling tube form a conical revolution gear ring.

5. The device according to claim 2, wherein said coupling tube is formed with a conical revolution surface.

6. The device according to claim 1, which comprises a stop and locking system for said torque transmission positioned at said opening by way of a screwed cover and a two-part ring.

7. The device according to claim 1, wherein:

a plurality of mandrels are coupled when driving to said secondary reduction gear through a drum rotating about the rotation axis; and the mandrels rotate about mutually parallel rotation axis positioned eccentrically on a drum diameter and parallel to the rotation axis.

8. The device according to claim 7, wherein:

said torque transmission comprises several coupling tubes respectively comprising a common axis of revolution;

said coupling tubes rotate concentrically about the common axis of revolution, each of said coupling tubes transmitting a torque to one of the mandrels via said secondary reduction gear; and two section ends of one of the coupling tubes is less spaced out than the spacing of the two section ends of one of the other coupling tubes.

9. The device according to claim 8, which comprises a tubular guide positioned inside said coupling tube with a relatively smaller diameter for transporting at least one of a hydraulic fluid, a lubricant, and an electrical conductor by way of said torque transmission.

10. The device according to claim 7, wherein said torque transmission comprises several coupling tubes respectively having an axis of revolution, and said coupling tubes rotate around revolution axes in juxtaposed parallel.

11. The device according to claim 10, wherein each coupling tube is independently removable through said opening.

12. The device according to claim 10, wherein:

said coupling tubes with splines are freely fixed into a retaining support equipped with rotating nozzles; and said retaining support is removable through said opening.

13. The device according to claim 10, wherein the mandrels are mounted to have angular velocities independently adjustable in torque and direction.

14. The device according to claim 1, wherein at least one of the mandrels is configured with at least one of two driving modes during coiling and uncoiling of a strip according to a direction of torque transmitted to the mandrel.

15. The device according to claim 1, which comprises guide supports disposed in a vicinity of said opening, enabling each coupling tube to be positioned opposite a channel for insertion into or withdrawal out of said unitary assembly.

16. A maintenance process, which comprises:

providing the device according to claim 1;

releasing at least one coupling tube and extracting the coupling tube from the unitary assembly through the opening;

subjecting the coupling tube to a maintenance operation; and reinserting the coupling tube through the opening and locking the coupling tube in the unitary assembly.

17. The maintenance process according to claim 16, which comprises releasing and extracting the coupling tube from the unitary assembly after final installation of the primary and secondary reduction gears according to the assembled configuration.

* * * * *